United States Patent [19]

Wang et al.

[11] 4,196,092

[45] Apr. 1, 1980

[54] CONDITIONING AGENT FOR FROTH FLOTATION OF FINE COAL

[75] Inventors: Samuel S. Wang, Cheshire; Morris E. Lewellyn, Stamford; Eugene L. Smith, Jr., Milford, all of Conn.

[73] Assignee: American Cyanamid Company, Stamford, Conn.

[21] Appl. No.: 897,230

[22] Filed: Apr. 17, 1978

[51] Int. Cl.[2] ..... C11D 7/34; C11D 9/32

[52] U.S. Cl. ..... 252/61; 209/5; 209/166; 252/307; 252/353; 252/354

[58] Field of Search ..... 252/61, 353, 307, 354; 209/5, 166

[56] References Cited

U.S. PATENT DOCUMENTS

| | | | |
|---|---|---|---|
| 2,785,134 | 3/1957 | Mathews et al. | 252/354 |
| 3,102,856 | 9/1963 | Chase | 209/166 |
| 3,793,218 | 2/1974 | Canevari | 252/354 |
| 3,910,855 | 10/1975 | Abeles | 252/354 |
| 3,915,391 | 10/1975 | Mercade | 209/5 |
| 4,052,331 | 10/1977 | Dumoulin | 252/354 |

*Primary Examiner*—Mayer Weinblatt

*Attorney, Agent, or Firm*—William J. van Loo; Frank M. Van Riet

[57] ABSTRACT

A conditioning agent comprising a frother and a bis(alkyl)ester of a sulfosuccinic acid salt provides high coal recovery with reduced ash content.

3 Claims, No Drawings

CONDITIONING AGENT FOR FROTH FLOTATION OF FINE COAL

CROSS-REFERENCE TO RELATED APPLICATIONS

This application is related to application Ser. No. 897,233, filed on Apr. 17, 1978. The instant application relates to a conditioning agent and the related application relates to a process of use thereof.

This invention relates to a composition useful in the froth flotation of fine coal. More particularly, this invention relates to such a composition comprising a bis(alkyl)ester of a sulfosuccinic acid salt and a frothing agent.

Fine coal resulting from mining operations and having a particle size of about minus 28 mesh is conventionally froth floated for recovery and sulfur removal. In the conventional process, the fine coal is froth floated using a frothing agent alone or a combination of frothing agent and an oil. Although at optimum dosage of frothing agent high recovery of coal is obtained, the amount of ash resulting upon combustion of the recovered coal is higher than desired. This ash content reduces the BTU value of the coal and can contribute to air pollution. Accordingly, there exists the need for improved conditioning for use in the froth flotation of fine coal which reduces ash content of fine coal without sacrifice in coal recovery. The provision for such conditioning agent would fulfill a long-felt need and constitute a significant advance in the art.

In accordance with the present invention, there is provided a conditioning agent for use in the froth flotation of fine coal which comprises from about 1 to about 99 weight percent of a frother and, correspondingly, from about 99 to about 1 weight percent of a bis(alkyl)ester of a sulfosuccinic acid salt of the general structure

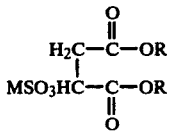

wherein R is a linear or branched chain alkyl group of about 3 to 20 carbon atoms and M is a cation providing a water-soluble salt.

The conditioning agent of the present invention provides high coal recovery and unexpectedly reduces the ash content associated with the recovered fine coal. The composition can also eliminate requirements for oil as an extruder for the frothing agent and can offset adverse effects on recovery resulting from excessive usage of oil.

As indicated, the conditioning agent of the present invention consists of two essential ingredients, a frother and a bis(alkyl)ester of a sulfosuccinic acid. The frother employed may be any of the conventional frothing agents normally used in the froth flotation of fine coal. Such agents include, for example, alcohols containing about 4 to 12 carbon atoms or mixtures thereof, cresylic acids and polyoxyalkyleneglycol types, a preferred species being a mixture of $C_4$–$C_8$ alcohols.

The bis(alkyl)esters of a sulfosuccinic acid salt will have the general structure

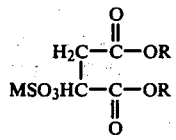

wherein R is a linear or branched chain alkyl group of about 3 to 20 carbon atoms, preferably about 4 to 13 carbon atoms, and M is a cation providing a water-soluble salt, preferably a sodium, potassium, or ammonium cation.

The proportions of essential ingredients in the conditioning agent will generally comprise from about 1 to 99 weight percent of frother, preferably about 50 to 75 weight percent thereof, and, correspondingly, from about 99 to 1 weight percent of bis(alkyl)ester of a sulfosuccinic acid salt preferably about 50 to 25 weight percent thereof, the weight percentages being based on the total weight of frother and bis(alkyl)ester of a sulfosuccinic acid salt. Water and other diluents may be present in the conditioning agent, if desired.

In carrying out froth flotation of fine coal, an aqueous slurry of the fine particles is conventionally conditioned with effective amounts of frother and optionally an oil and then subjected to froth flotation by standard procedures. In carrying out processing using the conditioning agent of the present invention, a suitable aqueous slurry of fine coal is conditioned with an effective amount of the conditioning agent described and then subjected to froth flotation by standard procedures. The effective amount will vary depending upon the source of the fine coal and other factors. Generally, the effective amount will be in the range of about 0.01 to 2.0 pounds per ton of fine coal, preferably about 0.05 to 0.5 pound per ton of fine coal. The usage of conditioning agent will normally be in the same range as conventional usages of frother alone. Oil is generally not required when the conditioning agent of the present invention is employed, but oil may be used as an added extruder if desired. Oil, if used, will follow conventional usage. Suitable oils are those derived from petroleum or animal and vegetable products, preferably a fuel oil.

The fine coal arises from mining operations as an aqueous slurry of varying coal contents, usually from about 2 to 15 weight percent. Such slurry is conditioned for a brief time period with the conditioning agent or combination thereof with oil. Such conditioning may be from a few seconds to a few minutes to ensure uniform distribution throughout the slurry.

After the slurry is properly conditioned, it is subjected to conventional froth flotation procedure. In such procedure, air bubbles are introduced into the slurry to form a froth on the surface of the slurry. The air bubbles attach to coal particles and cause them to levitate and become part of the froth, which is continually skimmed from the slurry, thus isolating the desired coal particles from other ingredients in the slurry. The recovered coal is washed, filtered, and dried to provide combustible material of greatly reduced ash content. Typically, the untreated coal particles contain 42% ash and this content is considerably reduced by froth flotation using the conditioning agent of the present invention.

The invention is more fully illustrated by the examples which follow wherein all parts and percentages are by weight unless otherwise specified.

EXAMPLES 1-18

A series of froth flotations were run on a sample of fine coal obtained from a leading processor. The coal particles were minus 28 mesh. Using an 8.0% aqueous suspension of the crude coal of about 10% ash, a comparative run (A) was made using a mixture of $C_4$ to $C_8$ alcohols as frothing agent. A number of bis(alkyl)esters of sulfosuccinic acid, sodium salt were run at the same dosage as frother above. An additional number of runs were made using a combination of the conventional frother and a bis(alkyl)ester of sulfosuccinic acid, sodium salt.

The various results obtained and details of the runs are given in Table I which follows.

The results show the reduced ash content obtained by the conditioning agent of the present invention. Such reduction leads to higher BTU values for the coal.

TABLE I

FROTH FLOTATION OF FINE COAL

| EXAMPLE NO. | FROTHER IDENTITY | EMPLOYED AMOUNT[1] | BIS ESTER[2] IDENTITY | EMPLOYED AMOUNT[1] | COAL RECOVERY(%) | ASH IN CONCENTRATE(%) |
|---|---|---|---|---|---|---|
| COMPARATIVE | $C_4$—$C_8$ ALCOHOL | 0.2 | — | 0 | 98.06 | 7.12 |
| 1 | — | 0 | Bis(isobutyl) | 0.2 | 97.35 | 7.11 |
| 2 | $C_4$—$C_8$ ALCOHOL | 0.15 | Bis(isobutyl) | 0.05 | 97.84 | 5.91 |
| 3 | $C_4$—$C_8$ ALCOHOL | 0.1 | Bis(isobutyl) | 0.1 | 98.13 | 5.46 |
| 4 | — | 0 | Bis(amyl) | 0.2 | 96.53 | 5.53 |
| 5 | $C_4$—$C_8$ ALCOHOL | 0.15 | Bis(amyl) | 0.05 | 97.99 | 5.71 |
| 6 | $C_4$—$C_8$ ALCOHOL | 0.1 | Bis(amyl) | 0.1 | 97.87 | 5.52 |
| 7 | — | 0 | Bis(hexyl) | 0.2 | 97.10 | 4.97 |
| 8 | $C_4$—$C_8$ ALCOHOL | 0.15 | Bis(hexyl) | 0.05 | 97.69 | 5.83 |
| 9 | $C_4$—$C_8$ ALCOHOL | 0.1 | Bis(hexyl) | 0.1 | 96.84 | 5.76 |
| 10 | — | 0 | Bis(cyclohexyl) | 0.2 | 93.52 | 5.04 |
| 11 | $C_4$—$C_8$ ALCOHOL | 0.15 | Bis(cyclohexyl) | 0.05 | 97.90 | 5.66 |
| 12 | $C_4$—$C_8$ ALCOHOL | 0.1 | Bis(cyclohexyl) | 0.1 | 96.62 | 5.04 |
| 13 | — | 0 | Bis(2-ethylhexyl) | 0.2 | 69.17 | 4.39 |
| 14 | $C_4$—$C_8$ ALCOHOL | 0.15 | Bis(2-ethylhexyl) | 0.05 | 96.66 | 3.60 |
| 15 | $C_4$—$C_8$ ALCOHOL | 0.1 | Bis(2-ethylhexyl) | 0.1 | 95.97 | 5.05 |
| 16 | — | 0 | Bis(isodecyl) | 0.2 | 85.11 | 5.08 |
| 17 | $C_4$—$C_8$ ALCOHOL | 0.15 | Bis(isodecyl) | 0.05 | 97.50 | 5.52 |
| 18 | $C_4$—$C_8$ ALCOHOL | 0.1 | Bis(isodecyl) | 0.1 | 95.46 | 5.27 |

Notes:
[1]Pounds per ton of coal.
[2]Bis(ester) of sulfosuccinic acid, sodium salt.

EXAMPLE 19

A further series of froth flotations were run to demonstrate that the conditioning agents used in the process of the present invention can replace the oil used in conventional frother-oil combinations. The fine coal processed was obtained from a different source than that used in the previous examples. The slurry contained 4.6% crude coal of about 42.0% ash. In a comparative run (B), the coal slurry was froth-floated using only a $C_4$–$C_8$ alcohol mixture as frother. In another comparative run (C), a mixture of the $C_4$–$C_8$ alcohol frother and No. 2 fuel oil was used to froth-float the coal. In an embodiment of the present invention, bis(tridecyl)sulfosuccinic acid, sodium salt, was used to replace the oil in comparative run (C). Results and details of these runs are given in Table II, which follows.

TABLE II

FROTH FLOTATION OF FINE COAL

| EXAMPLE NO. | FROTHER[1] DOSAGE (lb./ton) | NO. 2 FUEL OIL DOSAGE (lb./ton) | BIS(TRIDECYL)[2] ESTER DOSAGE (lb/ton) | RECOVERY (%) | ASH(%) |
|---|---|---|---|---|---|
| Comparative B | 0.4 | 0 | 0 | 77.61 | 10.06 |
| Comparative C | 0.4 | 1.0 | 0 | 87.72 | 11.21 |
| 19 | 0.4 | 0 | 0.14 | 84.26 | 10.14 |

NOTES:
[1]$C_4$—$C_8$ Alcohol Mixture.
[2]Bis(tridecyl)sulfosuccinic acid, sodium salt.

The results show that a small usage of a bis(alkyl)ester of a sulfosuccinic acid salt effectively replaces a larger quantity of fuel oil.

EXAMPLE 20

The same fine coal slurry source used in Example 19 was employed. In a comparative run (D), the amount of oil used in comparative run (C) was increased. In an embodiment of the invention, a small quantity of the bis(alkyl)ester used in Example 19 was added to combination of frother and fuel oil. Details and results are given in Table III, which follows.

TABLE III

FROTH FLOTATION OF FINE COAL

| EXAMPLE NO. | FROTHER[1] DOSAGE (lb/ton) | NO. 2 FUEL OIL DOSAGE (lb/ton) | BIS(TRIDECYL)[2] ESTER DOSAGE(lb/ton) | RECOVERY (%) | ASH(%) |
|---|---|---|---|---|---|
| Comparative D | 0.4 | 2.0 | 0 | 79.65 | 10.14 |
| 20 | 0.4 | 2.0 | 0.14 | 87.63 | 11.07 |

NOTES:
SEE TABLE II

These results show that the bis(alkyl)ester of sulfosuccinic acid salt can overcome the adverse affects on recovery of excess oil.

We claim:

1. A conditioning agent which consists essentially of from about 1 to about 99 weight percent of a mixture of $C_4$–$C_8$ alcohols, correspondingly, from about 99 to about 1 weight percent of a bis(alkyl)ester of a sulfosuccinic acid salt of the general structure

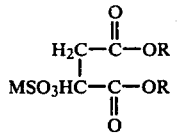

wherein R is a linear or branched chain alkyl group of 3 or 4 carbon atoms and M is a cation providing a water-soluble salt and, optionally, a fuel oil.

2. The conditioning agent of claim 1 wherein said bis(alkyl)ester of a sulfosuccinic acid salt is the bis-(isobutyl)ester of sodium sulfosuccinate.

3. The conditioning agent of claim 1 also containing a fuel oil.

* * * * *